United States Patent [19]

Boie et al.

[11] 4,407,929

[45] Oct. 4, 1983

[54] COLOR PHOTOGRAPHIC RECORDING MATERIAL FOR THE PRODUCTION OF COLORED IMAGES BY THE DYE DIFFUSION TRANSFER PROCESS

[75] Inventors: Immo Boie, Langenfeld; Kaspar Wingender, Leverkusen, both of Fed. Rep. of Germany

[73] Assignee: Agfa-Gevaert Aktiengesellschaft, Leverkusen, Fed. Rep. of Germany

[21] Appl. No.: 324,777

[22] Filed: Nov. 25, 1981

[30] Foreign Application Priority Data

Dec. 1, 1980 [DE] Fed. Rep. of Germany ..... 3045183

[51] Int. Cl.[3] ..... G03C 5/54; G03C 1/40; G03C 1/10

[52] U.S. Cl. ..... 430/220; 430/207; 430/212; 430/223

[58] Field of Search ..... 430/212, 218, 223, 220, 430/207

[56] References Cited

U.S. PATENT DOCUMENTS

| | | | |
|---|---|---|---|
| 3,185,567 | 5/1965 | Rogers | 430/223 |
| 4,139,379 | 2/1979 | Chasman et al. | 430/223 |
| 4,232,107 | 11/1980 | Janssens | 430/223 |
| 4,329,411 | 5/1982 | Land | 430/220 |

*Primary Examiner*—Richard L. Schilling
*Attorney, Agent, or Firm*—Connolly and Hutz

[57] ABSTRACT

In a color photographic recording material for the dye diffusion transfer process a transparent layer support, a light sensitive element, a light-reflecting opaque layer and an image-receiving layer form in that order a non-disconnectable assembly of layers and the light-sensitive element contains at least one silver halide emulsion layer and associated therewith an electron donor compound and a non-diffusing reducible color-providing compound that when reduced liberates a diffusible dye under alkaline development conditions. The material provides "development control on viewing" when the first part, e.g. about 2 minutes, of total development is conducted in dark and is completed at ambient light.

6 Claims, 1 Drawing Figure

COLOR PHOTOGRAPHIC RECORDING MATERIAL FOR THE PRODUCTION OF COLORED IMAGES BY THE DYE DIFFUSION TRANSFER PROCESS

This invention relates to a color photographic recording material for the production of colored images by the dye diffusion transfer process which is characterized by a particular layer arrangement and by the selection of a specific type of color-providing compounds.

In the dye diffusion transfer process it is usual to use a photo-sensitive element containing color-providing compounds and an image-receiving element in which the desired colored image is produced by the image-wise transfer of diffusible dyes. For this purpose, it is necessary to have firm contact between the photo-sensitive element and the image-receiving element at least for a finite period during development so that the image-wise distribution of diffusible dyes produced in the light-sensitive element as a result of development may be transferred to the image-receiving element. The contact may be established during development or it may be established prior to development. The latter applies, for example, if a material is used in which the photosensitive element and the image-eceiving element form an integral unit. Embodiments of the dye diffusion transfer process are known in which an integral unit of this type remains in existence even upon completion of development, i.e. separation of the photo-sensitive element from the image-receiving element is not proposed, even after transfer of the dye. An embodiment of this type is described, for example in DE-AS No. 1,924,430. However, according to another embodiment, the image-receiving element bearing the finished image after dye transfer may be separated from the photo-sensitive element, for example, by means of a stripping layer arranged between the two elements. Reference is made, for example, to DE-OS No. 2,049,688 for details of such an embodiment.

If the photo-sensitive element and the image-receiving element (in the form of an image-receiving layer) are arranged on the same layer support and are not separated after development, an opaque light-reflecting layer is generally arranged therebetween which is permeable to alkaline processing solutions and which causes optical separation between the dye image retained in the photo-sensitive element and the transferred dye image produced in the image-receiving layer and which forms a suitable background to the transferred dye image. The presence of an opaque layer of this type between the image-receiving layer and the photo-sensitive element also requires that the layer support be transparent, regardless on which side it is located, as it should be possible to expose image-wise the photo-sensitive element from one side and to observe the colored image produced in the image-receiving layer from the other side.

An integral color photographic recording material is described in DE-AS No. 1,924,430 which contains a transparent layer support on both sides of an assembly of layers consisting of photo-sensitive element, opaque light-reflecting layer and image-receiving layer. This material is designed to be developed in daylight. For this purpose there is provided a container which may be split open and which contains a processing liquid comprising a developer and an opacifying agent, the container being arranged in such a way that, during development, its contents spread between the photo-sensitive element and the juxtaposed transparent layer support so that, once development has started, the photo-sensitive element is subsequently protected from incident light on one side by the previously formed opaque layer and on the other side by the layer formed from the processing liquid containing the opacifying agent. In view of the incorporation of the splittable container and the connecting means effecting the integral cohesion of the constituents needed in the recording material, a recording material of this type is obviously extremely expensive to produce. Moreover, it is not possible to produce images in every desired format using such material. Furthermore, such material does not allow the production of the image to be specifically influenced as all of the agents for carrying out development including final neutralization are integrated into the matrial and external intervention is not possible without damaging the integral character. Owing to the narrow exposure latitude inherent in the color diffusion materials, faulty exposures are frequently given to the recording material and this results in a large proportion of unsatisfactory results due to the inability to intervene from outside.

An object of the present invention is to provide a color photographic recording material which is suitable for printing purposes and for taking photographs, which is simple in composition and which may be processed simply, which may be cut and which thus permits the production of pictures of various formats, the development of which may be observed and optionally influenced at ambient light.

SUMMARY OF THE INVENTION

The present invention relates to a color photographic recording material for the production of colored images by the dye diffusion transfer process using a transparent layer support, a photo-sensitive element containing at least one photo-sensitive silver halide emulsion layer and a non-diffusion color-providing compound associated therewith, an opaque light-reflecting layer and an image-receiving layer which may be dyed with diffusing dyes and the improvement consists in that the transparent layer support, the photo-sensitive element, the opaque light-reflecting layer and the image-receiving layer form a non-disconnectable assembly in the sequence indicated and that the silver halide emulsion layer or layers is/are provided with:

(1) An electron donor compound (ED Compound);
(2) a non-diffusing reducible color-providing compound which, in reduced form, liberates a diffusible dye under alkaline development conditions.

Essential layer elements of the recording material according to the present invention therefore include:

(1) a transparent layer support;
(2) a photo-sensitive element;
(3) an opaque light-reflecting layer;
(4) an image-receiving layer;

which form a non-disconnectable assembly of layers in the sequence indicated. This means that they are superimposed in a manner which never permits separation of the layers during production, storage, processing and subsequent preservation of the finished picture under normal conditions, even temporarily. In particular, separation of the layers between the transparent layer support and the photo-sensitive element should not be possible. The above-mentioned layer elements are usually coated on top of each other in the sequence indicated and adhere firmly to each other. Particular attention should be paid to the fact that no border is needed at the edges for holding the various layers together. Furthermore, it should be pointed out that no further layer support is provided apart from the above-mentioned transparent layer support.

DETAILED DESCRIPTION OF THE INVENTION

Figure 1:
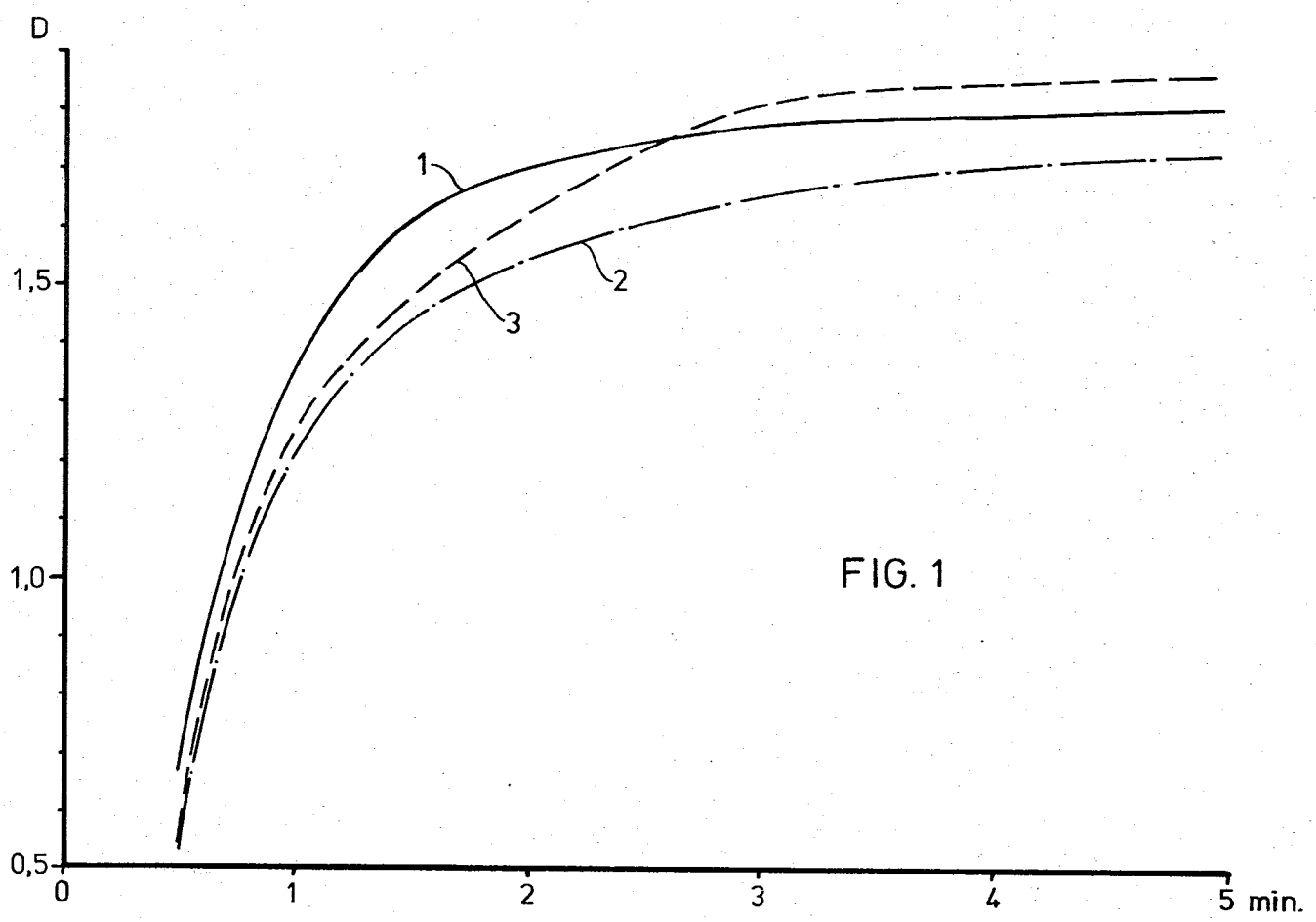

The conventional transparent layer support materials used for photographic purposes, for example films of cellulose esters, polyethylene terephthalate, polycarbonate or other film-forming polymers, may be used as transparent layer support (layer element 1) for the present color photographic recording material.

The photo-sensitive element (layer element 2) is also an important constituent in the present integral color photographic recording material. In the case of a single dye transfer process, it contains a photo-sensitive silver halide emulsion layer and a non-diffusible color-providing compound associated therewith. The color-providing compound may be located in a layer adjacent to the silver halide emulsion layer or in the silver halide emulsion layer itself. To produce multi-colored transfer images in natural colors, however, the photo-sensitive element generally contains three such associations of color-providing compound and photo-sensitive silver halide emulsion layer, the absorption range of the dye image resulting from the color-providing compound generally coinciding substantially with the range of the special sensitivity of the associated silver halide emulsion layer. It may be desirable for achieving maximum sensitivity if the color-providing compound is arranged in a separate binder layer behind (viewed in the direction of the incident light during exposure) the silver halide emulsion layer or has an absorption which differs from that of the dye image formed therefrom (for example, "shifted dyes images", see U.S. Pat. No. 3,854,945). Between the various associations of silver halide emulsion layers of different spectral sensitivity and color-providing compound alkali-permeable separating layers are generally provided which essentially have the function of preventing falsification of color. Such separating layers are particularly effective if they contain compounds capable of rendering diffusing developer oxidation products harmless.

As color-providing compounds the photo-sensitive element (layer element 2) of the present color photographic recording material contains in association with the differently sensitive halide emulsion layers non-diffusing compounds which are reducible by so-called "ED compounds" under the alkaline development conditions and which may be split in the reduced state under the alkaline development conditions with liberation of diffusible dyes. Color-providing compounds of this type are known, for example, from DE-OS No. 2,809,716 and EP-A No. 0,004,399. Examples of particularly suitable color-providing compounds corresponding to the following general formula:

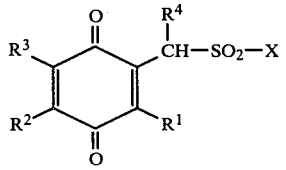

wherein

X represents the radical of a diffusible dye or dye precursor;

$R^1$, $R^2$, $R^3$ represent hydrogen, halogen, alkyl, alkoxy, aryl or acylamino, or $R^2$ and $R^3$ complete a fused ring;

$R^4$ represents hydrogen or alkyl;

and wherein at least one of the radicals $R^1$, $R^2$, $R^3$ and $R^4$ contains a diffusion-preventing radical.

In general, X represents the radicals of dyes from all known classes of dyes, providing that they are sufficiently diffusible to be able to diffuse through the layers of the photo-sensitive material into the image-receiving layer. For this purpose, the dye radicals may be provided with one or more water-solubilizing groups. Suitable water-solubilizing groups include carboxyl groups, sulfo-groups, sulfonamide groups, as well as aliphatic or aromatic hydroxy groups, However, the sulfinic acid group remaining in the dye after the splitting process gives the dye molecule a considerable tendency to diffuse in the alkaline medium so that the presence of additional water-solubilizing groups is not essential. Dyes which are particularly suitable for the process according to the present invention include, for example: Azo dyes, azomethine dyes, anthraquinone dyes, phthalocyanine dyes, indigo dyes, triphenylmethane dyes, including those which are complexed with metal ions or may be complexed with metal ions after diffusion transfer.

The term "radical of dye precursors" refers to the radicals of those compounds which are converted into dyes in the course of photographic processing by conventional or additional stages of processing whether by oxidation, by coupling or by liberation of an auxochromic group in a chromophoric system, for example by saponification. Dye precursors in this sense may be leuco dyes, couplers or even dyes which are converted into other dyes in the course of processing.

The alkyl and alkoxy radicals represented by $R^1$, $R^2$ and $R^3$ may be straight- or branched-chain and generally contain up to 18 carbon atoms. Examples include methyl, n-propyl, t-butyl, tetradecyl, octadecyl, methoxy, dodecoxy and tetradecoxy.

In the acylamino radicals represented by the above-mentioned radicals, the acyl groups are derived from aliphatic or aromatic carboxylic or sulfonic acids. The condensed rings completed by $R^2$ and $R^3$ are preferably carbocyclic rings, for example benzene or bicyclo [2,2,1]-heptene rings.

An alkyl radical represented by $R^4$ may be straight- or branched-chain, substituted or unsubstituted and may contain up to 21 carbon atoms. Examples include methyl, nitromethyl, phenylmethyl (benzyl), heptyl, tridecyl, pentadecyl, heptadecyl and $—C_{21}H_{43}$.

Diffusion-preventing radicals include those radicals which permit the compounds used according to the present invention to be incorporated in a diffusion-proof manner into the hydrophilic colloids conventionally used in photographic materials. Organic radicals generally containing straight- or branched-chain aliphatic groups and optionally also isocyclic or heterocyclic or aromatic groups generally containing from 8 to 20 carbon atoms are eminently suitable for this purpose. These radicals are bonded to the other part of the molecule either directly or indirectly, for example bonded via one of the following groups: —NHCO—, $—NHSO_2—$, —NR—, wherein R represents hydrogen or alkyl, —O— or —S—. The diffusion-preventing radical may additionally contain water-solubilizing groups, such as sulfo groups or carboxyl group, which may also be present in anionic form. As the diffusion properties depend on the molecular weight of the whole compound used, it is sufficient in certain cases, for example if the molecule used is sufficiently large, also to use shorter-chained radicals as "diffusion-preventing radicals".

Furthermore, the photo-sensitive element (layer element 2) also contains the above-mentioned ED compounds associated with the various silver halide emulsion layers. These are reducing agents which are oxidized image-wise under the alkaline development conditions by exposed silver halide or by oxidation products of auxiliary developer compounds and which are also capable of reducing the reducible color-providing compounds under the same conditions. The ED compounds should retain their association with a certain silver-halide emulsion layer and the associated non-diffusible color-providing compound even during the processing and therefore have at most only restricted mobility. They are preferably incorporated in a diffusion-proof form into the respective layers. The ED-compounds are, for example, non-diffusible derivatives of hydroquinone, of p-aminophenol, of benzisoxazolone or of ascorbic acid (for example, ascorbyl palmitate). Such compounds are known, for example, from DE-OS No. 2,809,716. Particularly desirable ED-compounds are described in DE-OS No. 3,006,268.

The terms "association" and "associated" mean that the reciprocal arrangement of silver halide emulsion layer, non-diffusible color-providing compound and non-diffusible or minimally diffusible ED-compound is of such a type that an interaction is possible which permits image-wise conformity between the silver image formed and image-wise distribution of the oxidation product of the ED-compound on the one hand and image-wise distribution of the ED-compound not oxidized during silver halide development and image-wise distribution of liberated diffusible dye on the other hand.

The photo-sensitive silver halide emulsions may be simple negative or direct-positive emulsions depending on the respective designation. The actual dye-forming system used according to the present invention operates positively, i.e. the liberation of dye takes place in conformity with the image-wise distribution of the undeveloped silver halide. For the production of positive copies of positive originals it is therefore sufficient to use simple negative emulsions.

As another essential constituent, the present color photographic recording material contains above the photo-sensitive element an opaque light-reflecting layer (layer element 3) which is permeable to aqueous alkaline solutions. This layer essentially has the function of screening the dye image retained in the light-sensitive element during development from the observation side and of supplying an aesthetically attractive background for the transferred colored image produced in the image-receiving layer. This is achieved in a known manner by a binder layer containing a light, in particular white, pigment, for example $TiO_2$.

The image-receiving layer of the present color photographic recording material (layer element 4) consists essentially of a binder containing the mordant for fixing the diffusible dyes liberated from the non-diffusible color-proving compounds. Preferred mordants for anionic dyes include long-chained quaternary ammonium or phosphonium compounds or tertiary sulfonium compounds, for example those described in U.S. Pat. Nos. 3,271,147 and 3,271,148. It is also possible to use certain metal salts and the hydroxides thereof which form sparingly soluble compounds with the acidic dyes. Furthermore, polymeric mordants should also be mentioned, such as those described in DE-OS No. 2,315,304, DE-OS No. 2,631,521 or DE-OS No. 29 41 818. The dye mordants are dispersed in the mordant layer in one of the conventional hydrophilic binders, for example in gelatine, polyvinyl pyrrolidone, completely or partially saponified cellulose esters. Some binders may obviously also act as mordants, for example mixed polymers or polymer mixtures of vinyl alcohol and N-vinyl pyrrolidone, as described, for example, in DE-AS No. 1,130,284, also those which represent polymers of nitrogen-containing quaternary bases, for example polymers of N-methyl-2-vinyl pyridine, as described, for example, in U.S. Pat. No. 2,484,430. Other suitable mordant binders include, for example, guanylhydrazone derivatives of alkyl vinyl ketone polymer as described for example in U.S. Pat. No. 2,882,156 or guanylhydrazone derivatives of acryl styrene polymers as described, for example, in DE-OS No. 2,009,498. However, other binders, for example gelatines, will generally be added to the last-mentioned mordant binders.

In addition, the present color photographic recording material may contain further layers in particular embodiments. Thus, a hardened protective layer may be arranged above the image-receiving layer in order in particular, to protect the image-receiving layer with the colored image produced therein during development from mechanical damage. A protective layer of this type may optionally also contain matting agent. It goes without saying that protective layers of this type must be permeable to aqueous alkaline processing solutions, at least during development. Moreover, an additional light-absorbing layer which may comprise, for example a binder containing a dark pigment, such as carbon black, distributed therein may be contained between the photo-sensitive element and the opaque light-reflecting layer. A layer of this type represents additional protection for the photo-sensitive element from light incident from the observation side and helps to improve the sharpness. It also makes the colored image retained in the photo-sensitive element and visible through the transparent layer support appear uniformly darker and thus less noticeable. Furthermore, additional layers may be provided in a known manner on the other side of the transparent layer support of the present recording material providing they are sufficiently transparent to allow the imagewise exposure of the photo-sensitive element through the transparent layer support. An additional layer of this type may, for example help to improve the flatness and may contain one or more correcting dyes to improve the color definition of the present color photographic recording material. Furthermore, to improve the overall optical impression in such a layer, means may be provided to produce an opaque covering over the negative image produced in the photo-sensitive element. A transparent layer of this type may, for example, contain a substance which produces a white haze with another substance contained in the developer bath. Thus, for example, barium chloride, which reacts with sodium sulfate contained in the developer to form white barium sulfate, may be incorporated in the backing layer. The combination of barium sulfite in the transparent backing layer and zinc sulfate in the developer bath, for example, is made to DE-OS No. 2,127,924, with respect to such techniques.

The present color photographic recording material may be provided in the form of individual sheets or even in strip form, as required, as it is simple to produce. The present color photographic recording material is not subject to any restriction with regard to the format. It may also be cut to the required size by the user as desired prior to processing, making it possible to produce borderless pictures in various formats without subsequent cutting.

The present color photographic recording material is equally suitable as a material for taking photographs and as a print material, the exposure being undertaken through the transparent layer support. Basically, when used as a material for taking photographs any camera is suitable and expensive specialized apparatus of the type found in the conventional instant picture cameras is not required. To produce colored prints, the image-wise exposure of the present color photographic recording material is usually carried out in a dark room, for example in contact with a transparent colored original or using a conventional projection enlarger.

A simple processing operation follows which essentially involves bringing the exposed color photographic recording material into contact with an alkaline developer. This may be effected, for example, by immersing the material into a suitable developer bath in the conventional manner or by applying a developer preparation in the form of a paste to the image-receiving layer of the present color photographic material. Instead of liquid or paste developer preparations, it is also possible to use simple alkaline baths or pastes if the developer substances required for example phenidone or derivatives thereof, are incorporated into one or more layers of the present color photographic recording material, for example into the image-receiving layer, the opaque light-reflecting layer or one or more layers of the photo-sensitive element. Development using liquid developer baths may be carried out in simple containers, for example in dishes, tanks or conventional commercial domestic developing drums.

It has surprisingly been found that the present color photographic recording material may safely be exposed to light after an initial processing time in the dark of a few minutes so that the formation of the color transfer image may be observed in the dye-receiving layer without subsequent exposure having a significant influence on the colored image to be produced. Although the silver halide development is not yet concluded and subsequently exposed silver halide is further developed, as demonstrated by the fact that the photo-sensitive element visible through the transparent layer support is colored more darkly, this does not essentially affect the quality of the colored image produced. It is thus possible to observe the formation of the dye transfer image and to terminate the development or the subsequent diffusion of the image dyes upon reaching an adequate color density, as desired, for example by reducing the pH in the color photographic recording material by immersion into a weakly acidic stopping bath until the dye anions liberated are converted into the corresponding no longer diffusible dye acids and a stable image is obtained. This possibility of influencing the image ("development control on viewing") is a feature of the present color photographic recording material which is probably due to the non-diffusible reducible color-providing compounds used according to the present invention.

Other color photographic recording materials of comparable structure, but using other color-providing compounds, do not afford this possibility, as premature subsequent exposure of the photo-sensitive element which would be unavoidable with the present arrangement would give dye transfer images which had inadequate color densities, for example when using dye developers according to DE-AS No. 1,196,075, or had intolerably high minimal densities (fog), for example when using non-diffusible color-providing redox compounds according to DE-OS No. 2,242,762. A black-and-white material which contains a photo-sensitive layer on a transparent layer support, an opaque light-reflecting layer thereon and an image-receiving layer thereon and which may be developed by the silver salt diffusion process (British Pat. No. 746,948) cannot be developed after viewing as too much silver is developed in the case of premature subsequent exposure of the photo-sensitive silver halide emulsion layer therein and insufficient balckness would accordingly be obtained in the image-receiving layer.

Another unexpected advantage of the present color photographic recording material resides in the fact that, in the conventional composition, the external image-receiving layer is sufficient to fix almost completely the diffusible dye liberated during development so that virtually no dye enters the developer if processing is carried out in liquid baths. Premature contamination of the developer baths by migrant dyes need not therefore be feared.

EXAMPLE 1

A light-sensitive element of a photographic recording material according to the present invention was produced by applying the following layers in succession to a transparent polyethylene terephthalate layer support. The quantities each relate to 1 $m^2$.

1. Blue-sensitive AgBr negative emulsion composed of 0.5 g $AgNO_3$, 0.357 g of compound A (yellow dye former), 0.306 g of compound B (ED compound), 0.663 g of palmitic acid diethylamide (oil-forming agent) and 1.164 g of gelatine.
2. Yellow filter layer containing 0.16 g of yellow dye Solvent Yellow 29 (C.I. 21230), 0.2 g of 2-isooctadecyl-5-sulfo-hydroquinone and 1.0 g of gelatine.
3. Green-sensitized AgBr negative emulsion composed of 0.5 g of $AgNO_3$, 0.314 g of compound C (magneta dye former), 0.223 g of compound B, 0.537 g of diethyl lauramide (oil-forming agent) and 1.037 g of gelatine.
4. Intermediate layer containing 0.12 g of 2-isooctadecyl-5-sulfo-hydroquinone, 0.60 g of compound D (developer) and 1.0 g of gelatine.
5. Red-sensitized AgBr negative emulsion composed of 0.5 g of $AgNO_3$, 0.30 g of compound E (cyan dye former), 0.162 g of compound B, 0.462 g of palmitic acid diethylamide and 0.962 g of gelatine.
6. Opaque light-reflecting layer containing 18 g $TiO_2$ and 2.57 g of gelatine.
7. Image-receiving layer containing 3.46 g of a polymeric mordant composed of 4,4'-diphenylmethane diisocyanate and N-ethyl diethanolamine, quaternized with epichlorhydrin according to DE-OS No. 2,631,521, Example 1, and 3.46 of gelatine.

8. Protective and hardening layer containing 1.2 g of Compound F (hardening agent) and 0.6 g of gelatine.

The recording material is exposed through the transparent layer support behind a conventional neutral wedge and developed in an open dish at 22° C. for 3 minutes using a bath having the following composition:

927 g water
30 g isobutanol
3 g KBr
40 g KOH

The material is then washed for one minute and dried. A colored image having excellent color separation and the following D min/D max values is obtained:

| | Yellow | Magenta | Cyan |
|---|---|---|---|
| D min | 0.13 | 0.12 | 0.14 |
| D max | 1.67 | 1.55 | 1.80 |

When observed from the rear, through the transparent layer support, the negative formed in the photo-sensitive element (layers 1 to 5) differs weakly from general dark brown coloration.

EXAMPLE 2 AND DESCRIPTION OF THE FIGURE

Various samples of the recording material described in Example 1 were developed in an open dish in absolute darkness as in Example 1, but for a different period of time. FIGURE 1 shows the dependency of the developed color densities on the development time (curve 1: yellow density, curve 2: magenta density, curve 3: cyan density). It is seen that the maximum color densities are virtually attained after five minutes, but that a further marked increase in density occurs in the period from 2 to 5 minutes after beginning development.

Five more samples were also processed for five minutes, but artificial light was introduced after initial dark times of varying lengths and the remaining development was therefore in bright light. The influence of the artificial light should be revealed in a reduction in the maximum densities attainable. In fact, such a reduction in color density is only observed (Table 1) if the dark time is shorter than 2 minutes. This shows that after a dark time of 2 minutes, the image formation may safely be observed in daylight. The silver development is not yet completed after this time, as revealed by the fact that the silver halide emulsion layers are blackened more uniformly by the incidence of light. The dark initial coloration of the reverse of the images becomes more uniform and thus more desirable than in colored images which are developed completely in the dark.

TABLE 1

| Sample No. | Development time [min] dark/light | | D max Y | D max M | D max C | D min Y | D min M | D min C |
|---|---|---|---|---|---|---|---|---|
| 1 | 0.5 | 4.5 | 0.67 | 0.62 | 0.77 | 0.13 | 0.12 | 0.14 |
| 2 | 1.0 | 4.0 | 1.39 | 1.38 | 1.71 | 0.13 | 0.12 | 0.14 |
| 3 | 2.0 | 3.0 | 1.67 | 1.66 | 2.02 | 0.13 | 0.12 | 0.13 |
| 4 | 3.0 | 2.0 | 1.65 | 1.68 | 1.95 | 0.13 | 0.12 | 0.14 |
| 5 | 4.0 | 1.0 | 1.69 | 1.67 | 1.96 | 0.14 | 0.12 | 0.14 |
| 6 | 5.0 | 0 | 1.69 | 1.69 | 1.99 | 0.13 | 0.12 | 0.14 |

Y = yellow,
M = magenta,
C = cyan

EXAMPLE 3

Unexposed samples of the recording material described in Example 1 (material 1) were each developed for three minutes in 1 l of the developer bath described in Example 1 until a total throughput of 0.2 $m^2$ was reached.

Unexposed samples of a material (material 2) differing from that in Example 1 merely by the absence of the image-receiving layer (layer 7) were similarly developed in succession in a further volume of the developer bath described in Example 1, also 1 l; total throughput also 0.2 $m^2$.

The developer solution contacted with material 2 started to color strongly while the developer solution contacted with material 1 remained virtually colorless. Extinction measurements (layer thickness 1 cm) produced:

Material 1: E=0.16
Material 2: E=1.7 uniformly over the entire visible range of the spectrum. This shows that the mordant layer effectively retains the dye so that no undesirable discoloration of the processing bath occurs.

EXAMPLE 4

The present recording material was compared with similar materials containing, instead of the color-providing compound used according to the present invention (non-diffusible reducible compound which, in reduced form, liberates a diffused dye under alkaline developing conditions), other color-providing compounds.

Material 1 (according to the present invention)

Layers 5, 6 and 7 of the recording material described in Example 1, as well as a protective layer containing 0.6 g of gelatine were applied in succession to a transparent layer support.

Material 2 (according to the present invention)

The following were applied to a transparent layer support (per $m^2$) in succession:

a red-sensitized AgBr negative emulsion composed of 0.5 g of $AgNO_3$, 0.41 g of compound G (cyan dye former), 0.467 g of compound H (ED compound), 0.462 g of palmitic acid diethylamide and 0.962 g of gelatine (corresponding to layer 5 from Example 1), as well as the layers 6 and 7 from Example 1 and a protective layer containing 0.6 g of gelatine.

Material 3 (color-providing compound according to DE-OS No. 2,645,656)

The following were applied to a transparent layer support (per $m^2$) a green-sensitized direct reversal emulsion of the internal latent image type composed of 2.7 g of $AgNO_3$ (average particle size 1.8 $\mu$m), 0.005 mg of compound I (fogging agent), a layer containing 0.7 g of compound K (magenta dye former), 0.7 g of tricresyl phosphate and 1.4 g of gelatine, as well as the layers 6 and 7 from Example 1 and a protective layer containing 0.6 g of gelatine.

A solution having the following composition was used as developer:

51 g KOH
2 g $Na_2SO_3$ 3 g 4-hydroxymethyl-4-methyl-1-phenyl-3-hydroxypyrazoline 2 g 5-methylbenztriazole to 1,000 ml with water.

Various samples of materials 1, 2 and 3 were processed for differing periods firstly in the dark and then in the light (developed) with a total development time of 180 seconds for material 1 and 600 seconds for materials 2 and 3. The different total development times were necessary to obtain comparable color densities. Table 2 shows the percentage of dark time in the total development time a/(a+b), as well as the total development time (a+b) divided into dark time (a) and light time (b) for the various samples.

TABLE 2

| Material | Sample No. | Developing time a (S) | b (S) | a/(a+b) (%) | D min | D max |
|---|---|---|---|---|---|---|
| 1 | 1 | 180 | 0 | 100 | 0.32 | 1.66 |
| | 2 | 120 | 60 | 67 | 0.27 | 1.65 |
| | 3 | 90 | 90 | 50 | 0.29 | 1.61 |
| | 4 | 60 | 120 | 33 | 0.32 | 1.27 |
| | 5 | 36 | 144 | 20 | 0.34 | 0.84 |
| 2 | 1 | 600 | 0 | 100 | 0.22 | 1.08 |
| | 2 | 400 | 200 | 67 | 0.21 | 1.07 |

TABLE 2-continued

| Material | Sample No. | Developing time a (S) | b (S) | a/(a+b) (%) | D min | D max |
|---|---|---|---|---|---|---|
| | 3 | 300 | 300 | 50 | 0.23 | 0.91 |
| | 4 | 200 | 400 | 33 | 0.22 | 0.63 |
| | 5 | 120 | 480 | 20 | 0.21 | 0.43 |
| 3 | 1 | 600 | 0 | 100 | 0.24 | 1.39 |
| | 2 | 400 | 200 | 67 | 1.15 | 1.28 |
| | 3 | 300 | 300 | 50 | 0.92* 1.37 | 1.29 |
| | 4 | 200 | 400 | 33 | 1.74** | 1.76** |
| | 5 | 120 | 480 | 20 | 1.61** | 1.63** |

*counter-gradation is built up with a second D min value in the centre of the gradation curve

**no image-wise differentiation

Table 2 shows that light may safely be introduced after about 50 or 67% of the total processing time with the materials 1 and 2 according to the present invention. With material 3 which does not correspond to the present invention, however, a slight incidence of light drastically impairs the make-up of the image; a counter gradation is built up and no image-wise differentiation at all occurs with prolonged incidence of light.

Formulae:

A

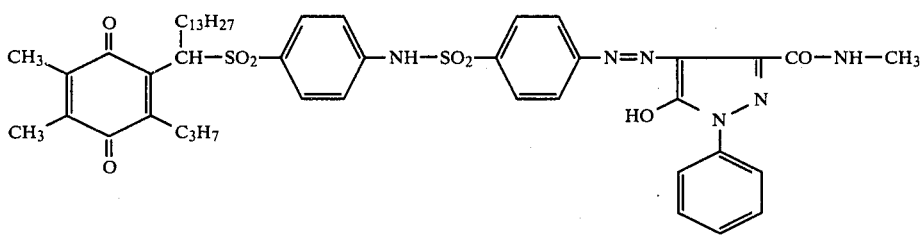

B

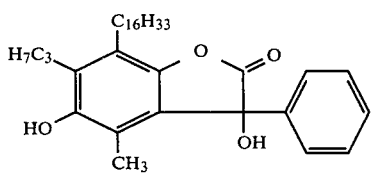

C

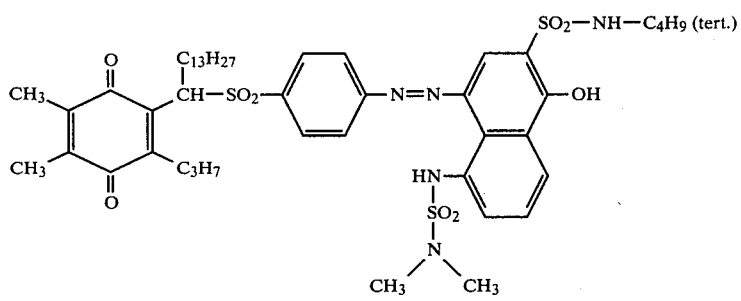

D

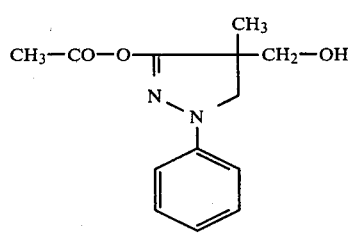

-continued

Formulae:

E

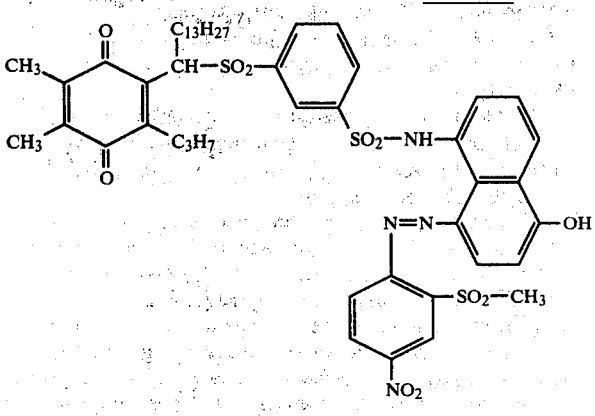

F

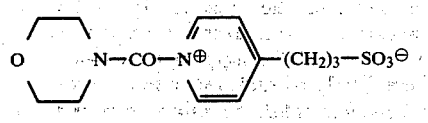

G

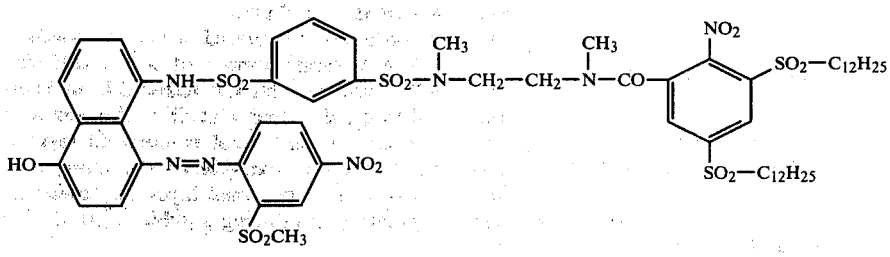

H

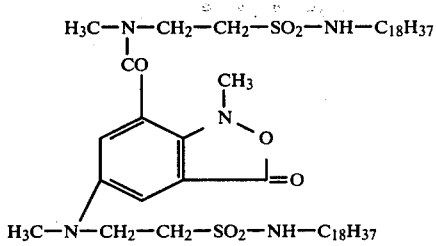

J

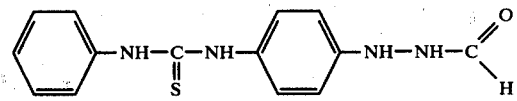

K

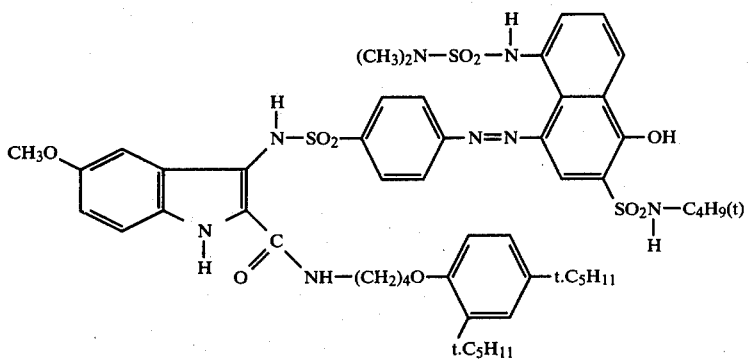

We claim:

1. The color photographic recording material, comprising a transparent layer support, a photo-sensitive element containing at least one photo-sensitive silver halide emulsion layer and a non-diffusing color providing compound associated therewith, an opaque light-reflecting layer and an image-receiving layer which may be dyed by diffusible dyes, in which the improvement comprises the transparent layer support, the photo-sensitive element, the opaque light-reflecting layer and the image-receiving layer form a non-disconnectable laminate in which the support, the element and the layers adhere firmly to each other in the sequence indicated and the silver halide emulsion layer or layers has/have associated to it/them:

(1) an electron donor compound (ED compound);

(2) as color-providing compound a non-diffusing reducible compound which, in reduced form, liberates a diffusible dye under alkaline development conditions.

2. The recording material as claimed in claim 1, in which a compound corresponding to the following general formula is used as color-providing compound:

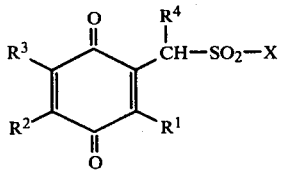

wherein

X represents the radical of a diffusible dye or dye precursor;

$R^1$, $R^2$, $R^3$ represent hydrogen, halogen, alkyl, alkoxy, aryl or acylamino, or $R^2$ and $R^3$ complete a fused ring;

$R^4$ represents hydrogen or alkyl; and wherein at least one of the radicals $R^1$, $R^2$, $R^3$ and $R^4$ contains a diffusion-preventing radical.

3. The recording material as claimed in claim 1, in which an additional transparent layer is arranged on the reverse side of the transparent layer support.

4. The recording material as claimed in claim 3, in which the additional transparent layer contains one or more dyes.

5. The recording material as claimed in claim 1, in which an additional opaque light-absorbing layer is arranged between the photo-sensitive element and the opaque light-reflecting layer.

6. The color photographic recording material, comprising a transparent layer support, a photo-sensitive element containing at least one photo-sensitive silver halide emulsion layer and a non-diffusing color providing compound associated therewith, an opaque light-reflecting layer and an image-receiving layer which may be dyed by diffusible dyes, in which the improvement comprises the transparent layer support, the photo-sensitive element, the opaque light-reflecting layer and the image-receiving layer form a non-disconnectable laminate in which the support, the element and the layers adhere firmly to each other in the sequence indicated and the silver halide emulsion layer or layers has/have associated to it/them:

(1) an electron donor compound (ED compound);

(2) as color-providing compound a non-diffusing reducible compound which, in reduced form, liberates a diffusible dye under alkaline development conditions and an additional transparent layer is arranged on the reverse side of the transparent layer support, said additional layer containing an agent capable of producing a white haze during processing.

* * * * *